United States Patent [19]

Haginomori

[11] 4,246,459

[45] Jan. 20, 1981

[54] GAS CIRCUIT BREAKER

[75] Inventor: Eiichi Haginomori, Tokyo, Japan

[73] Assignee: Tokyo Shibaura Denki Kabushiki Kaisha, Japan

[21] Appl. No.: 797,635

[22] Filed: May 17, 1977

[51] Int. Cl.[3] ..... H01H 33/88

[52] U.S. Cl. ..... 200/148 A; 200/148 B; 200/148 R

[58] Field of Search ..... 200/148 A, 148 R, 144 AP, 200/148 B, 148 C

[56] References Cited

U.S. PATENT DOCUMENTS

| | | | |
|---|---|---|---|
| 2,660,647 | 11/1953 | Rawlins | 200/148 A |
| 3,291,948 | 12/1966 | Telford | 200/148 A |
| 3,927,350 | 12/1975 | McConnell | 200/144 AP |
| 3,946,180 | 3/1976 | Votta et al. | 200/148 A |

*Primary Examiner*—Robert S. Macon

*Attorney, Agent, or Firm*—Stevens, Davis, Miller & Mosher

[57] ABSTRACT

In a gas circuit breaker of the type in which compressed gas is blasted about an arc generated by the separation of at least a pair of relatively movable contacts, there are provided an arc extinguishing chamber, a stationary contact mounted on the inside wall of the chamber, an operating rod located in the chamber, a movable contact disposed to oppose the stationary contact and moved by the operating rod, a device for creating a blast of compressed gas when the contacts are separated, and a plurality of partition plates separated from each other in the direction of the movement of the movable contact. The partition plates are provided with gas passing passages and function to channel the compressed gas and blast it about the arc at a plurality of spaced apart interrupting points.

1 Claim, 3 Drawing Figures

GAS CIRCUIT BREAKER

BACKGROUND OF THE INVENTION

This invention relates to a gas circuit breaker and more particularly a compressed gas circuit breaker employing multi-stage gas blasting about an arc generated by the separation of relatively movable contacts thereby improving the interrupting capacity.

Recently, demand for a circuit breaker with large interrupting capacity and compact size has been increased because of the enlargement of a power system and due to the limited space of installation. Furthermore, it has also been required to provide a simple and accurate circuit breaker construction in view of the cost and the reliability thereof.

In a conventional puffer-type (single gas-flow-type) gas circuit breaker the arc interruption is performed such that an operating rod is first pulled by means of an operating mechanism, and in accordance with the movement of the rod, a cylinder located within an arc extinguishing chamber of the circuit breaker is also moved, whereby the gas in the cylinder is compressed to a high pressure and the compressed gas is blasted through a nozzle part across, or about the arc gererated at the nozzle part thereby interrupting the arc. The breaking efficiency of this type of breaker is determined by the strength of the blasting action. In another conventional double gas-flow-type circuit breaker the blasting efficiency is duplicated in comparison with that of the single gas-flow-type mentioned above. However, in order to obtain a breaking efficiency higher than that of the former type, the latter type must increase the blast pressure or increase the number of serially connected interrupting points. This causes an enlargement in the structural configuration of the circuit breaker and an increase in the driving force which involves much cost making such a breaker uneconomical.

SUMMARY OF THE INVENTION

Accordingly, the principal object of this invention is to provide a compressed gas circuit breaker which can improve the interrupting capacity by blasting gas in a multi-stage gas flow about an arc at nozzle parts without increasing either the blast pressure of the gas or the number of serially connected interrupting points.

Another object of this invention is to provide an improved compressed gas circuit breaker with a simple construction and high reliability and such can be manufactured at a low cost.

According to this invention, there is provided a gas circuit breaker of the type in which compressed gas is blasted about an arc generated by the separation of at least a pair of relatively movable contacts. The gas circuit breaker comprises an arc extinguishing chamber, a stationary contact mounted on the inside wall of the chamber, an operating rod located in the chamber, a movable contact disposed opposingly to the stationary contact and moved by the operating rod, a device for creating a blast of compressed gas when the contacts are separated, and a plurality of partition plates separated from each other in the direction of the movement of the movable contact between the contacts, whereby the blast of the compressed gas is directed about the arc generated by the separation of the movable and stationary contacts so as to form a cylindrical gas flow enclosing the arc and to interrupt the arc at nozzle parts formed by the partition plates.

BRIEF DESCRIPTION OF THE DRAWINGS

Further objects and advantages of the invention will be more fully understood from the following detailed description taken in conjunction with the accompanying drawings in which.

DESCRIPTION OF THE PREFERRED EMBODIMENT

Figure 1:
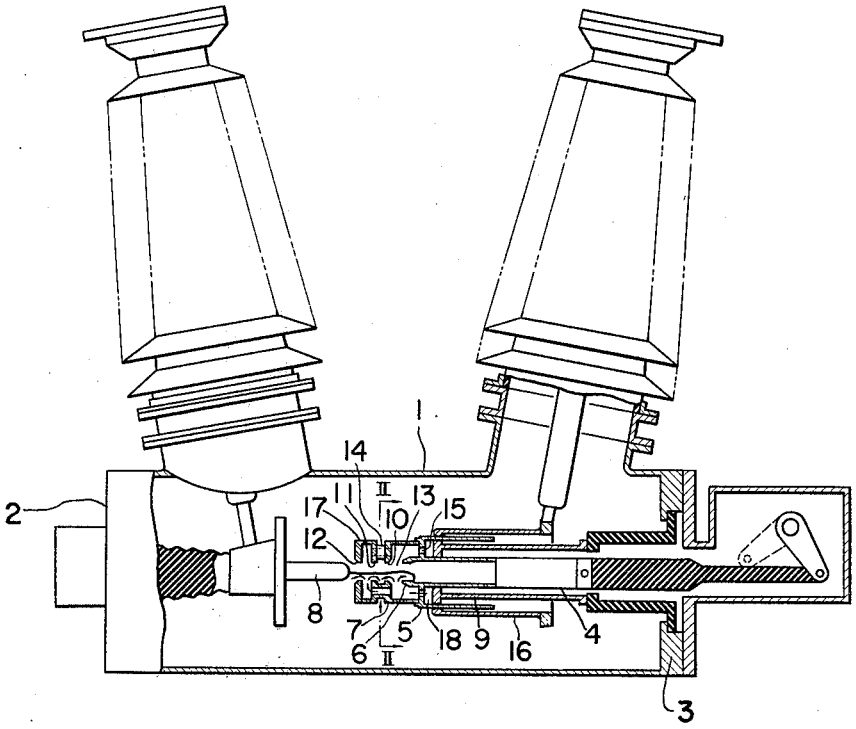
FIG. 1 shows a cross-sectional view of one embodiment of a circuit breaker according to this invention, in an opened condition.
Figure 2:
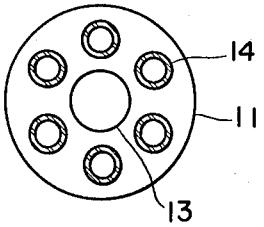
FIG. 2 shows a cross-section taken along the line II—II in FIG. 1.

FIG. 1 illustrates one embodiment of a puffer-type gas circuit breaker according to this invention and shows the manner of arc extinguishment. This circuit breaker comprises an arc extinguishing cylindrical chamber 1 (filled with an insulating gas such as sulfur hexa fluoride ($SF_6$)) and end plates 2 and 3. In the cylindrical chamber 1 there is provided a movable member including an assembly of an operating rod 4 driven by well known external operating means such as a link mechanism, a puffer cylinder 5, a tubular movable contact 6 and an insulating nozzle member 7. There are also provided a stationary contact 8 secured to the end plate 2 to oppose the movable contact 6 and a puffer piston 9 movable within the cylinder 5. The piston 9 is fixed at one end to the inner surface of the end plate 3. p The insulating nozzle member 7 is provided with three partition plates 10, 11 and 12 spaced from each other in the longitudinal direction of the cylindrical chamber 1 and positioned between the movable and stationary contacts when they are opened. A nozzle 13 is formed between the rightmost partition plate 10 and the contact 6. A plurality of pipes 14 extend through the space between the partition plate 10 and the intermediate partition plate 11, and the periphery of the space between the partition plates 11 and 12 is closed by a circumferential wall 17.

A puffer chamber 18 is defined by the puffer cylinder 5 and the puffer piston 9, and in the breaking operation the insulating gas in the puffer chamber 18 is compressed according to the movement of the operating rod 4 and blasted through small openings 15 provided in the cylinder 5. The blasted gas is then guided to the nozzle 13 by the insulating nozzle member 7. Because a slide contact 16 connected to the end plate 3 at one end thereof is slidably contacting the outer peripheral surface of the puffer cylinder 5, in the closed condition, a current path is formed from the end plate 2 to the end plate 3 through the stationary contact 8, the movable contact 6, the puffer cylinder 5 and the slide contact 16.

The breaking operation of the circuit breaker shown in FIG. 1 is as follows.

When the movable member is moved to the left by the operating rod 4 connected to the external operating means such as a link mechanism, the space between the contacts 6 and 8 are separated widely and the insulating gas in the puffer chamber 18 is compressed. The compressed gas under high pressure is blasted through the small openings 15 of the cylinder 5 and guided by the insulating nozzle member 7 so as to be blasted about the arc struck between separated contacts 6 and 8. At this moment, the compressed gas is blasted about the arc at four nozzle parts formed by the movable contact 6, and the partition plates 10, 11 and 12, through the pipes 14. The circuit breaker construction according to this invention increases the blasting efficiency 2 to 4 times in comparison with a conventional circuit breaker. In other words the same efficiency can be assured as in the case where the number of the serially connected interrupting points is larger.

The insulating nozzle member 7 shown in FIG. 1 may be constructed as an integral unit or as an assembly of a plurality of individual members.

Figure 3:
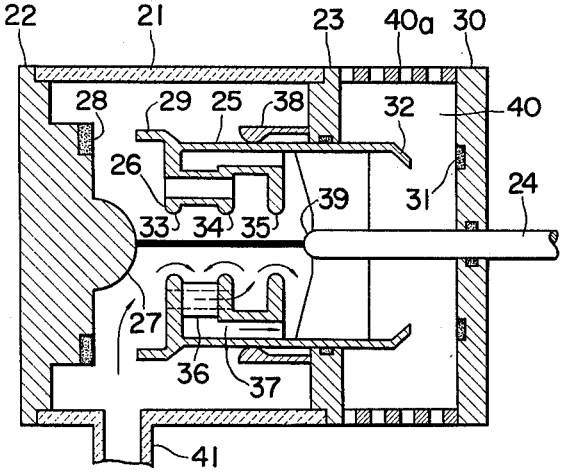
FIG. 3 shows a cross-sectional view of another embodiment in the breaking condition of a dual pressure type circuit breaker according to this invention.

FIG. 3 shows a dual pressure-type circuit breaker constructed in accordance with this invention in an arc extinguishing condition. In FIG. 3, an arc extinguishing chamber is formed by an arc extinguishing cylinder 21 made of insulator and end plates 22 and 23 closing gas-tightly the end openings of the cylinder 21 and filled with an insulating gas such as $SF_6$. In the cylinder 21 there are provided a movable member comprising an operating rod 24 driven by external operating means (not shown), a cylindrical movable contact 25 and a movable electrode 26, which are secured to the rod 24, and a stationary contact 27 connected to the end plate 22 to oppose the movable electrode 26.

The cylindrical movable contact 25 is provided with a valve member 29 facing to a packing 28 disposed at the periphery of the base of the stationary contact 27 and with a valve member 32 facing to a packing 31 located on an end plate 30 on gas exhausting side. Inside the cylindrical movable contact 25 are formed three partition plates 33, 34 and 35 separated from each other in the direction of movement of contact 25. The space between partition plate 33 adjacent the stationary contact 27 and the partition plate 35 is communicated with the exhaust side through a passage 37, and a plurality of pipes 36 extend through the partition plate 33 and the intermediate partition plate 34, whereby compressed gas introduced from an inlet port 41 into the cylinder 21 is fed into the space between the partition plates 33 and 34 around the inner edge of the partition plate 33 and to the space between the partition plates 34 and 35 through the pipes 36.

To the end plate 23 there is fixed a slide contact 38 at one end thereof and the other end of the slide contact 38 is slidably engaging the outer peripheral surface of the movable contact 25. In the closed condition, there is formed a current path from the end plate 22 to the end plate 23 through the stationary contact 27, the movable electrode 26, the movable contact 25 and the slide contact 38. An arc root 39 is formed on the movable contact 25 when an arc is struck as shown. An exhaust chamber 40 is formed between the end plate 23 and the plate 30, and a perforated cover **40*a* is provide to surround the exhaust chamber 40 for communicating it with the outside atmosphere or gas recovering device (not shown). In the closed condition, the inside of the cylinder 21 defined by the inner surface of the cylinder 21 and the outer surface of the movable contact 25 is filled with insulating gas under high pressure which is fed from the gas inlet port 41**.

The inlet port 41 is communicated with a well known compressed gas tank (not shown) disposed externally of the cylinder 21 through an electromagnetic valve (not shown) and when the operating rod 24 is moved, the valve is opened and the compressed gas in the tank is introduced into the cylinder 21 through the inlet port 41.

The breaking operation of this embodiment shown in FIG. 3 is as follows.

When the operating rod 24 is moved by the external operating means to the right as viewed in FIG. 3, the space between the contacts 25 and 27 is separated widely and the space between the valve member 29 and the packing 28 is also separated, whereby the insulating gas under high pressure fed from the inlet port 41 is blasted towards the center of the movable contact 25. The arc generated between the contacts 27 and the electrode 26 is transferred between contacts 27 and 24 by the blast of the insulating gas. During the transfer of this arc the compressed gas is blasted to surround the arc at three nozzle parts formed by the partition plates 33, 34 and 35 through the pipes 36 and the passage 37 so as to form a cylindrical compressed gas flow under high pressure enclosing the arc and to interrupt the arc at nozzle parts formed by the partition plates. Thus, the structure of the circuit breaker shown in FIG. 3 can improve the blasting efficiency by a factor of three over a conventional circuit breaker.

As a further modification of the circuit breaker there may be provided a double gas-flow-type circuit breaker including a hollow stationary contact through which compressed gas is passed or the same type of circuit breaker provided with a further partition plate disposed on the side of the stationary contact. Furthermore, the structure of this circuit breaker can be applied for a three-phase circuit breaker by providing barriers between respective arc extinguishing chambers.

As is clear from the above, the merits or advantages of this invention may be summarized as follows.

According to this invention, a plurality of partition plates are located so as to provide multi-stage gas blasting with respect to the nozzle parts formed by the partition plates, and the partition plates are provided with pipes and/or passage through which compressed gas is blasted to the respective nozzle parts, so that the interrupting capacity can be remarkably improved without increasing the blasting gas pressure or the number of the interrupting points. Moreover as the circuit breaker has a simple and compact construction, it can be installed in a limited space. Furthermore, since the blasting gas flow is reduced by selecting properly the diameter of the nozzle during the generation of the arc in the nozzle part, the comsumption of the gas is substantially equal to that of the conventional double gas-flow-type circuit breaker.

There is described herein embodiments employing only three partition plates, but the present invention is not limited thereto. Rather, the invention covers other modifications and changes obvious to those skilled in the art which do not depart from the scope and spirit of the invention.

I claim:

1. In a gas circuit breaker for high voltage use of the type comprising an arc extinguishing chamber, a stationary contact mounted on the inside wall of said chamber, an operating rod located in said chamber, and a movable contact disposed to oppose said stationary contact and be moved by said operating rod, and in which compressed gas is blasted about an arc generated by the separation of said stationary and movable contacts, the improvement which comprises means for creating a blast of compressed gas when said contacts are separated, and a plurality of partition plates spaced from one another in the direction of movement of said movable contact and provided within said chamber to surround said arc established between said separated contacts, said means for creating a blast of compressed gas comprising a puffer cylinder-piston assembly including a puffer cylinder integrally formed and moved together with said movable contact and a stationary puffer piston connected to one end of said arc extinguishing chamber, said plurality of plates being provided with passages extending between said plates and directed in the direction of the movement of said movable contact for channeling gas flow from said blast creating means to spaces between adjacent plates, and means for directing a part of the gas flow from said blast creating means to said arc for directly blasting said gas flow part about said arc and for directing another part of said gas flow through said passages to said arc for blasting said another part of said gas flow about said arc at a plurality of nozzle portions formed by said plates, the blasted gas flows not being remixed after arc interruption.

* * * * *